United States Patent [19]

Malservisi et al.

[11] Patent Number: 4,860,922

[45] Date of Patent: Aug. 29, 1989

[54] AUTOMATIC DISPENSER FOR CYLINDRICAL COMMODITIES, IN PARTICULAR PACKETS OF COIN

[75] Inventors: William Malservisi, Zola Predosa; Claudio Righetti, Bologna; Raffaele Nadalini, Zola Predosa; Umberto Braga, Castelmaggiore; Marino Romagnoli, S.Lazzaro Di Savena, both of Italy

[73] Assignee: Unimac s.n.c. di Nadalini Raffaele & C., Bologna, Italy

[21] Appl. No.: 277,259

[22] Filed: Nov. 29, 1988

[30] Foreign Application Priority Data

Dec. 4, 1987 [IT] Italy ..... 3722 A/87

[51] Int. Cl.[4] ..... G07F 11/16; G07F 9/02; B65H 5/00

[52] U.S. Cl. ..... 221/6; 221/14; 221/196; 221/234; 221/241; 221/242; 221/266

[58] Field of Search ..... 221/9, 14, 6, 10, 12, 221/13, 17, 18, 191, 192, 193, 194, 195, 196, 233, 234, 235, 236, 238, 241, 242, 257, 266, 298; 194/206, 207; 453/18, 29, 63

[56] References Cited

U.S. PATENT DOCUMENTS

| | | | |
|---|---|---|---|
| 1,999,887 | 4/1935 | Walker | 221/266 X |
| 2,840,265 | 6/1958 | Noyes | 221/12 X |
| 4,331,259 | 5/1982 | Imamura | 221/11 |
| 4,469,245 | 9/1984 | Fish et al. | 221/253 X |
| 4,526,292 | 7/1985 | Waxman | 221/195 X |

*Primary Examiner*—Joseph J. Rolla
*Assistant Examiner*—Edward S. Ammeen
*Attorney, Agent, or Firm*—Balogh, Osann, Kramer, Dvorak, Genova & Traub

[57] ABSTRACT

The dispenser includes a bin which is adjustable for width, and a release mechanism attached to the bin externally of its outlet. The mechanism comprises a sliding shutter and a baffle, vertically disposed and breasted in mutual contact. The shutter is provided with a slot of adjustable height and moves vertically between a raised receiving position and a lowered knockout position at which the packet of coins is ejected from the slot. The baffle is urged against the shutter by the weight of the packets of coin emerging from the outlet of the bin and thus accompanies the shutter at least through part of its vertical travel.

6 Claims, 2 Drawing Sheets

AUTOMATIC DISPENSER FOR CYLINDRICAL COMMODITIES, IN PARTICULAR PACKETS OF COIN

BACKGROUND OF THE INVENTION

The invention relates to an automatic dispenser for commodities of cylindrical shape in general, and for cylindrical packets of coins in particular. Widespread use is made of automatic cash dispensers to change paper money for coins packaged in tubular cardboard wrappers; such machines are employed at banks, especially, so as to avoid the formation of long queues at the service counters and speed up money-changing operations generally.

The typical cash dispenser consists essentially in a cabinet-like structure containing a plurality of chutes arranged one beside the next, each carrying a given type of coin, and a release mechanism for each chute; the chutes are all connected to a bank note acceptor.

Each chute is fashioned from two upright U-section channels disposed facing one another and set apart at a prescribed distance in such a way as to create a vertical enclosure into which the packets of coin are dropped from above.

The dimensions of the channel sections are such that the chute accommodates the packets in a single column. More exactly, the packets may be stacked in a zig-zag formation rather than in direct vertical alignment, though never two or more abreast in the horizontal; such an arrangement is essential in guaranteeing a smooth and uninterrupted feed as the chute gradually empties out.

This conventional stacking arrangement is a source of notable drawbacks in terms of restocking the machine, and thus limits its practical advantages. Attempts have been made to enlarge the dispenser's capacity by increasing the height of the single chutes, though restocking can become a troublesome procedure in this instance too, as the operator has to insert the packets of coin, singly, from a given height which is not always easily reached.

Accordingly, some designers have rejected the chute in favor of a bin of deeper capacity, in which the packets of coin can be stacked in random formation; dispensers of this design have shown an inevitable tendency to jam quickly, however, registering empty even though the bin may in fact be almost full. This is due to the fact that the packets are able to form a 'bridge' with one another once a given number are drawn from the bottom of the stack; in effect, when packets are removed from the bottom of the bin, those above settle into a substantially solid arch formation (similar to a brick or stone arch), which is compacted further by the weight of the packets occupying the upper part of the bin.

Accordingly, the object of the invention is to embody an automatic dispenser in which considerable quantities of wrapped coin can be accommodated, several packets deep, without 'bridging' as in a conventional dispensers; thus, the bin is certain to empty out completely without jamming, and one gains a notably increased interval of time between restocking operations.

SUMMARY OF THE INVENTION

The stated object is achieved with a dispenser as recited in the appended claims, in which use is made of a bin with an angled bottom that slopes down toward an outlet of height not less than twice the diameter of the coin dispensed, and an upright release mechanism, associated with the fixed wall of the bin above the outlet, comprising a shutter and a baffle disposed parallel and in contact with one another. The shutter affords a slot adjustable for height, and is reciprocated along its own axis between a raised position at which the packets of coin are received singly into the slot from the outlet of the bin, and a lowered position at which each packet is ejected by a knockout device; the baffle remains permanently in contact with the shutter, and reciprocates together with it through at least part of the distance separating the two positions.

One advantage of the dispenser according to the invention is that of its simplicity in design and its secure operation, obtained by virtue of the fact that the area of the bin where the packets of coin might tend to jam is of variable volume.

A further advantage of the dispenser disclosed is that it features a bin of standard embodiment with easily adjustable components, which can be adapted to accommodate cylindrical commodities of different diameter and length.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 2:
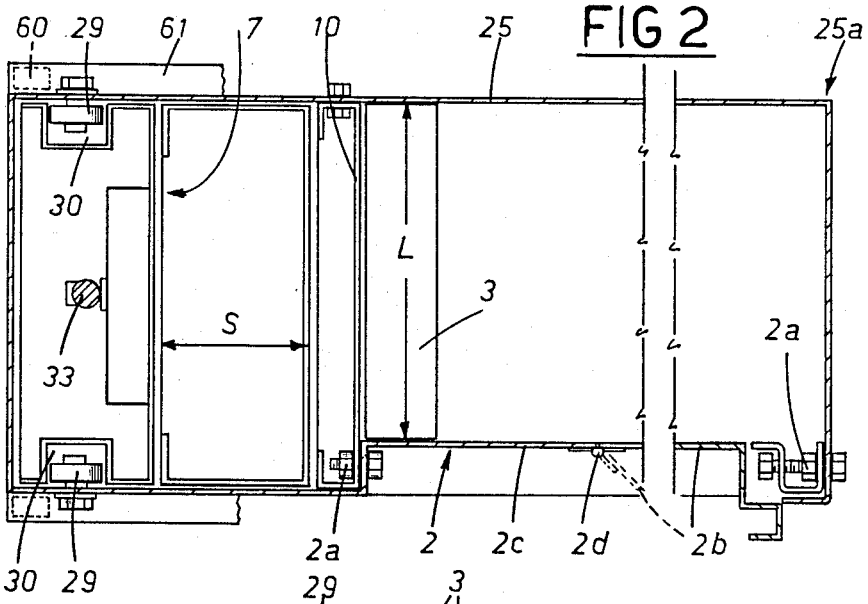
FIG. 2 shows the section through II—I in FIG. 1, with certain parts omitted better to reveal others, in particular the bin.

According to the invention, coins pre-wrapped in cylindrical packets 3 of a given length L (FIG. 2) are changed, for bank notes or vouchers, by an automatic dispenser comprising an upright bin 1, and a release mechanism 4 which is located at the back of the bin as viewed from the position of the user or operator, denoted O.

Figure 1:
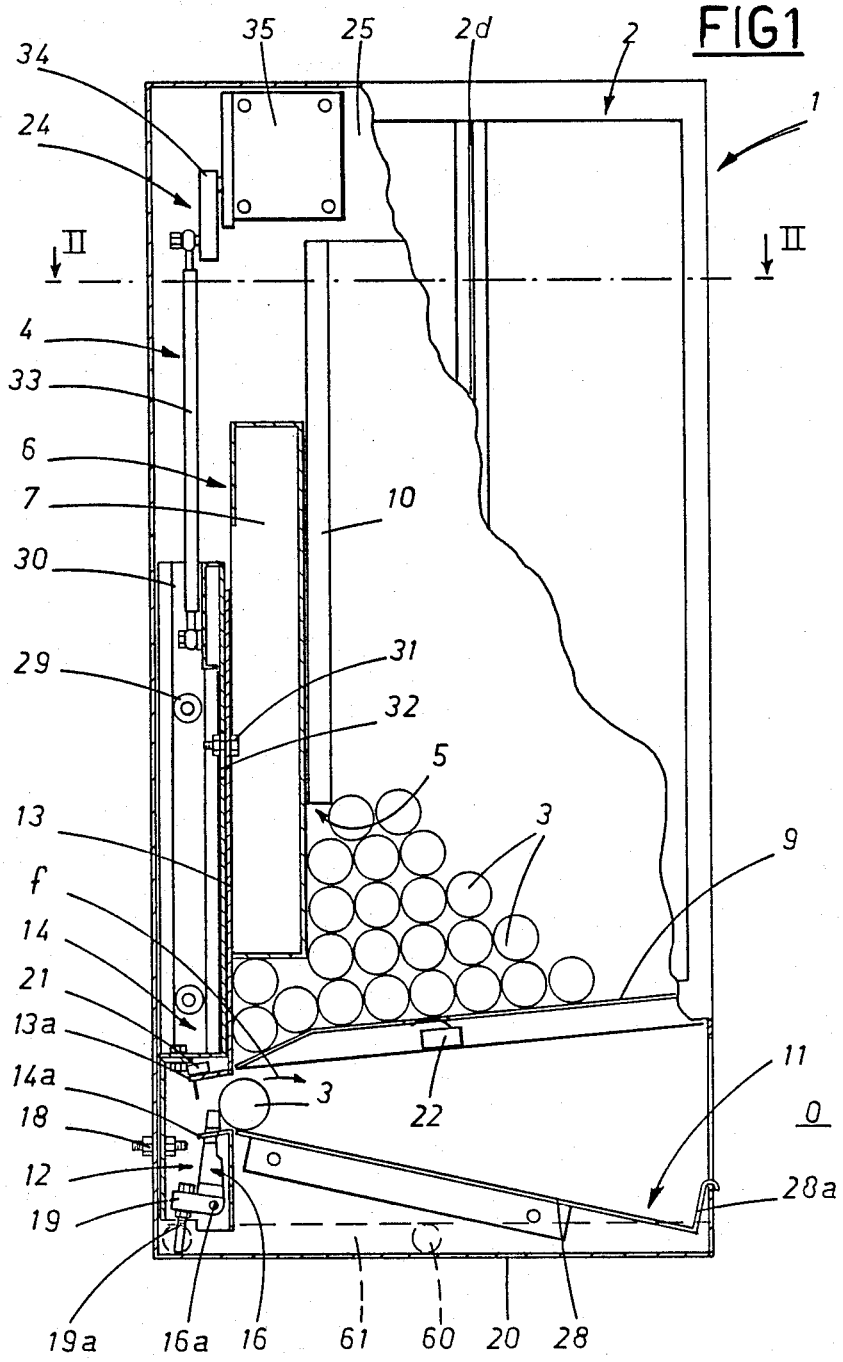
FIG. 1 is a cutaway side elevation of the dispenser according to the invention, in which certain parts are omitted better to reveal others.

In practice, the dispenser cabinet will consist in a plurality of bins 1 and mechanisms 4, disposed side by side considered in the direction normal to the plane of FIG. 1, each containing a different denomination of coin.

The space afforded by each bin 1 is encompassed by a rear wall 10 and a side wall 25, both fixed, and an adjustable side wall 2 disposed opposite to and parallel with the fixed side wall 25. More exactly, the fixed side wall 25 is disposed transversely to the axes of the cylindrical packets of coin 3, and bent through a right angle 25*a* to form the fourth and remaining wall of the bin 1.

The adjustable side wall 2 is capable of movement through a direction parallel with the axes of the packets 3. One part of the side wall in question, denoted 2*b*, is attached to the remaining part 2*c* by means of a vertical hinge 2*d*, and provides a flap affording access to the inside of the bin 1 for restocking purposes (see FIG. 2); the bin 1 and the release mechanism 4 are mounted on rollers 60 that run on tracks 61 fastened to the structure of the outer cabinet, allowing the operator simply to run the bin 1 forward beyond the front of the cabinet to expose the flap 2*b*.

The bin 1 is enclosed at bottom by a fixed shelf 9, affording a surface by which the stacked packets of coin 3 are supported and from which they ultimately roll off. 28 denotes a ramp located directly below the shelf 9, which accommodates the single packet of coins 3 dispensed from the bin 1 and is bent up at the front edge 28*a* to prevent it rolling beyond a given point, as will become clear in due course. The shelf 9 is angled, sloping downward toward the rear fixed wall 10 of the bin, whereas the ramp 28, which constitutes the dispensing tray 11 proper, slopes in precisely the opposite direction. 5 denotes an opening between the shelf 9 and the fixed rear wall 10, constituting the bin outlet, the overall height of which is not less than twice the diameter of the largest size of cylindrical packet 3 likely to be dispensed.

The bin release mechanism 4 consists in a sliding shutter 6 and a baffle 7, both of which vertically disposed and fashioned preferably from materials with a low coefficient of friction. In the example illustrated, the baffle 7 is lightweight, fashioned from sheet metal looped into a C-profile of depth S substantially equal to a given horizontal distance through which the shelf 9 is made to project beyond the fixed rear wall 10, and lies breasted parallel with the rear wall 10 of the bin.

The sliding shutter 6 is disposed parallel to and in permanent contact with the baffle 7, and made to reciprocate vertically, parallel with its own axis. The shutter is embodied essentially in two distinct and vertically aligned sections (fashioned likewise from sheet metal bent into suitable shape), namely, a first parallelepiped section 14 reflecting the fundamental geometry of the shutter and affording an inwardly-bent lip 14*a* at bottom on which each packet of coins 3 released from the bin 1 comes to rest, and second section 13, consisting simply in a vertical panel fastened to the parallelepiped section 14, which is also bent inward to create a further lip 13*a*; the mutually opposed surfaces of the two lips 13*a* and 14*a*are disposed parallel and create a slot 8, angled in the same direction as that of the shelf 9, designed to accommodate one packet of coins 3 only.

The second section 13 is fitted to the first 14 in such a way as to allow adjustment of its position through a vertical path, for example by means of bolts 31 and slots 32 (FIG. 1) in similar fashion to the adjustable wall 2 of the bin 1 (FIG. 2); in this way, it becomes possible to adjust the height of the slot 8 to match the diameter of the packet of coins 3 dispensed.

The first section 14 is embodied with two vertical channels 30, one at each side, creating a pair of U-shaped tracks that are occupied by corresponding guide rollers 29 mounted to the sides of the bin 1. 24 denotes drive means with which the shutter 6 is associated, and by which it is reciprocated; in the example of FIG. 1, such means consist in a rod 33, driven by a crank arm 34 keyed to the shaft of a motor 35 mounted to the fixed side wall 25 of the bin.

The first section 14, hence the entire shutter 6, is reciprocated by the drive means 24 at least between a raised receiving position, in which the slot 8 lies substantially in alignment with the shelf 9 and can thus accept a packet of coins 3 (see phantom line, FIG. 3), and a lowered knockout position in which the slot 8 coincides essentially with the topmost level of the tray 11 (FIG. 1). 12 denotes a knockout device associated with the shutter 6, which operates whenever the shutter is moved into the lowered position (FIG. 1). In the embodiment illustrated, such a device 12 comprises a lever 16 hinged about a central pivot 16*a*to the first section 14 and exhibiting two arms, of which one arm 17 lies with at least its projecting end internally of the slot 8 and serves to prevent the packet of coins 3 rolling beyond the lip 14*a*; the remaining arm 19 carries an adjustable locator 19*a* (a simple setscrew) which is designed to register against a fixed stop as the shutter 6 approaches the knockout position. In the case in point, the fixed stop is afforded by the base 20 of the bin. The operating position of the device 12 is selected by means of an adjustable stop 18, associated with the first section 14, against which the lever 16 is urged under the weight of the released packet of coins 3.

An automatic dispenser according to the invention will also comprise a CPU (not illustrated), and two sensing elements 21 and 22 the purpose of which is to verify the presence or otherwise of a packet of coins 3, respectively in the slot 8, whenever the shutter 6 is in a stand-by position (shortly to be described), and on the shelf 9 of the bin.

Figure 3:
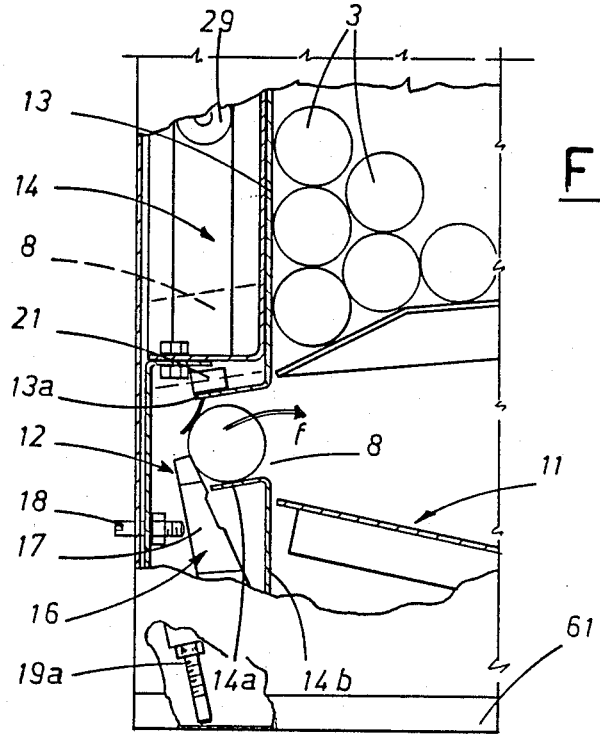
FIG. 3 shows a detail of FIG. 1 in which certain of the components illustrated are seen in a different operating position.

The stand-by position of the shutter 6 is that of FIG. 3 (bold line), with the slot 8 lying between the receiving and knockout positions, and in terms of operation, marginally prior to the moment in which the locator 19*a* engages the base 20 of the bin as the shutter descends.

Before setting the release mechanism 4 in readiness for initial commissioning, or when converting the bin to dispense a different denomination of coin, the bin itself must be adapted to accept the size of packet 3. First, the distance between the fixed wall 25 and the adjustable wall 2 must be set to match the length L of the packets of coin 3, using the screws 2*a*. This done, the panel screws 31 and the stop 18 are adjusted to set the height and the depth of the slot 8, respectively; it will be seen from FIG. 1, in fact, that by raising the second section 13 in relation to the first section 14, the height of the slot 8 can be increased to accept coin of a diameter greater than that illustrated, and in this event, the depth must also be increased correspondingly by setting the stop 18 in such a way as to allow the lever arm 17 sufficient travel in the backwards direction to make certain that the packet 3 is encompassed completely by the slot 8, and thus prevented from projecting and striking against the edge of the shelf 9. Accordingly, the stop 18 is set in such a way that the forward-most crest of the packet 3 occupying the slot is aligned with the front surface 14*b* of the shutter 6.

It will be seen in FIG. 3 that, with the shutter in the stand-by position, the arm 19 remains distanced from the base 20 of the bin 1 to ensure that the packet 3 remains stably inside the slot 8, whatever the diameter of coin.

If, when the dispenser is operated, the sensor 21 in the slot 8 is excited by contact with a packet of coins 3, the motor 35 will start up and lower the shutter 6, bringing the locator 19*a* down onto the base 20 of the bin 1 and causing the lever 16 to rotate toward the tray 11 in the direction of the arrow f (FIG. 1).

The packet of coins 3 is thus knocked forward by the relative arm 17 of the lever 16 and passes from the slot 8 onto the tray 11, rolling down in the direction of the user and coming to rest finally against the front edge 28*a*, from where it can be picked up. In the meantime, the shutter 6 begins returning upward to regain the receiving position. On arrival of the shutter at the raised position, the packet of coins 3 next in line, hitherto held back by the shutter 6 itself, is allowed to roll into the vacant slot 8, whereupon the rest of the packets shift down in the bin and settle behind it. In the event that the slot 8 should remain vacant on returning to the raised position due to the lack of further packets, then the sensor 21 will fail to excite, a signal is triggered to denote the empty condition, and the bin is switched out of order. It will be observed from FIG. 1 that the baffle 7 is urged against the panel 13 by the weight of the packets pushing through the bin outlet 5, and as the mechanism reascends, the baffle rises a certain distance together with the shutter. This movement of the baffle 7 is rendered possible due to the fact that the force generated by sliding friction acting on the entire surface of contact between the two components 6 and 7 far outstrips the limited weight of the baffle, and its effect is of causing the packets of coin 3 to shift forward toward the shutter and thus fill the space hitherto occupied by the bottom end of the baffle itself. When the shutter next descends, the baffle will descend with it, given that the sliding friction between these two components 6 and 7 is stronger than the rolling friction between the baffle 7 and the cylindrical packets 3, until finally obstructed by a packet 3 directly beneath, as in FIG. 1.

As long as the slot sensor 21 continues to excite in response to the entry of a packet 3, the shutter will continue to descend automatically to the lower position. The moment that the stock of packets 3 internally of the bin 1 falls below a given number, the area of the shelf 9 occupied by the remaining sensor 22 will be vacated, and the sensor 22 itself will excite, triggering a signal to advise that the bin is almost empty and needs restocking.

With each descent and ascent of the shutter 6, the baffle 7 is drawn with it as described above, with the result that one has a variation in the volume of the outlet zone 5 between the fixed rear wall 10 and the shelf 9; accordingly, the packets of coin 3 are prevented from forming bridges internally of the bin 1, and continue to be dispensed smoothly, without mishap, until the bin is emptied.

What is claimed:

1. An automatic dispenser for cylindrical commodities, in particular packets of coin, comprising:

a bin including means for adjusting the width of the bin and a bottom, said bin being enclosed at the bottom by an angled shelf that slopes downward toward an outlet located in a vertical rear wall of the bin and communicating with a release mechanism by which packets of coin are dispensed singly; said release mechanism including a vertically disposed sliding shutter provided with a slot that is angled in the same direction as that of the angled shelf, wherein said slot includes means for adjusting its height and wherein said shutter moves said slot between at least a raised position, in which the slot and the shelf are substantially in alignment and a packet of coins can be received into the slot, and a lowered knockout position in which the slot lies substantially level with a dispensing tray;

knockout means for engaging the packet of coins occupying the slot and ejecting it from the slot onto the dispensing tray; and a vertically disposed baffle parallel with and freely accommodated between the shutter and the rear wall adjacent to the outlet, and urged into contact with the shutter by the weight of the packets of coin emerging from the bin by way of the outlet.

2. A dispenser as in claim 1, wherein the shutter and the baffle are embodied in material having a low coefficient of friction.

3. A dispenser as in claim 1, wherein the height of the outlet is not less than twice a diameter of a largest-diameter packet of coins likely to be dispensed.

4. A dispenser as in claim 1, wherein the shutter includes two sections, a first parallelepiped section reflecting the geometry of the shutter and bent inwards at the bottom to create a lip on which each packet of coins dispensed from the bin comes to rest, and a second section including a vertical panel attached to the first section and bent inwards at bottom to create a further lip; and wherein mutually opposed surfaces of the two lips are parallel, angled in the same direction as the angled shelf, and constitute the slot of the shutter.

5. A dispenser as in claim 1, wherein the shutter includes a lip and said knockout means includes at least one lever with two arms, hinged about a centrally located pivot to the shutter beneath the slot and maintained normally in a position in which one of the two arms registers against a stop, wherein the stop includes means for adjusting it according to the diameter of coin dispensed and wherein the one arm includes a projecting end and lies at least with said projecting end internally of the slot in such a way as to arrest the packet of coins rolling from the bin onto the lip, and the remaining arm registers against a fixed stop as the shutter approaches the knockout position, in such a way that the lever is made to rotate in a direction that causes the packet of coins to be ejected from the slot.

6. A dispenser as in claim 5, further comprising:

first sensing means for verifying the presence of packets of coin internally of the bin; and second sensing means for verifying the presence of a single packet of coins occupying the slot of the shutter, and for enabling or inhibiting movement of the shutter from an intermediate stand-by position reached during descent from the receiving position to the knockout position.

* * * * *